US008052080B2

(12) United States Patent
Liang

(10) Patent No.: US 8,052,080 B2
(45) Date of Patent: Nov. 8, 2011

(54) ROPE BREAKING DEVICE

(76) Inventor: Feng-Chia Liang, Taichung (TW)

( * ) Notice: Subject to any disclaimer, the term of this patent is extended or adjusted under 35 U.S.C. 154(b) by 279 days.

(21) Appl. No.: 12/462,228

(22) Filed: Jul. 31, 2009

(65) Prior Publication Data

US 2011/0024542 A1 Feb. 3, 2011

(51) Int. Cl.
*B65H 75/48* (2006.01)

(52) U.S. Cl. ..... 242/371; 242/379

(58) Field of Classification Search ..... 242/371, 242/379

See application file for complete search history.

(56) References Cited

U.S. PATENT DOCUMENTS

| | | | | | |
|---|---|---|---|---|---|
| 3,760,910 | A * | 9/1973 | Koshihara | 188/180 |
| 3,907,256 | A * | 9/1975 | Kankkunen | 242/381 |
| 3,946,989 | A * | 3/1976 | Tsuda | 182/241 |
| 4,000,881 | A * | 1/1977 | Matsumoto | 182/241 |
| 4,108,280 | A | 8/1978 | Eastcott et al. | 187/20 |
| 4,511,123 | A * | 4/1985 | Ostrobrod | 254/364 |
| 4,602,699 | A * | 7/1986 | Matt | 182/234 |
| 4,877,110 | A * | 10/1989 | Wolner | 182/232 |
| 5,186,289 | A * | 2/1993 | Wolner et al. | 188/180 |
| 5,351,906 | A * | 10/1994 | Feathers | 242/396.6 |
| 5,799,753 | A * | 9/1998 | Peltier | 182/234 |
| 7,780,146 | B2 * | 8/2010 | Casebolt et al. | 254/346 |
| 2004/0245048 | A1 * | 12/2004 | Ribic | 182/231 |
| 2010/0308149 | A1 * | 12/2010 | Allington et al. | 242/379 |

* cited by examiner

*Primary Examiner* — Sang Kim

(57) ABSTRACT

A rope braking device includes a housing having a chamber and an orifice communicative with each other, an eyelet engaged in the orifice of the housing and having a bore for engaging with a rope, a pulley having a hub mounted on a shaft, a follower gear mounted on the shaft and coupled to the hub, an internal gear rotatably mounted on the shaft, a number of pinions engaged with the follower gear and the inner teeth of the internal gear for resisting the rotational movement of the pulley and the rope relative to the housing, and for allowing the rope braking device to be easily carried with the user and to be easily operated by the user.

10 Claims, 9 Drawing Sheets

ROPE BREAKING DEVICE

BACKGROUND OF THE INVENTION

1. Field of the Invention

The present invention relates to a rope braking device, and more particularly to a rope braking device including an improved and simplified structure for effectively braking the rope and for allowing the rope braking device to be easily carried with the user and to be easily operated by the user.

2. Description of the Prior Art

Typical rope friction hoist devices comprise two friction wheels mounted for independent rotation on a common shaft and permitted limited axial motion with respect to one another to carry a rope, and a rope braking device provided for engaging with the wheels.

For example, U.S. Pat. No. 4,108,280 to Eastcott et al. discloses one of the typical rope friction hoist devices comprising a braking apparatus provided for engagement with outer faces of the wheels, and the opposed inner faces of adjacent wheels are provided with a braking material such that actuation of the braking apparatus forces the wheels together and the wheels are braked as a unitary structure.

However, the typical braking apparatus is useable for the typical rope friction hoist devices only, but may not be carried with the user and may not be easily operated by the user when the user is climbing with the rope.

The present invention has arisen to mitigate and/or obviate the afore-described disadvantages of the conventional rope braking devices.

SUMMARY OF THE INVENTION

The primary objective of the present invention is to provide a rope braking device including an improved and simplified structure for effectively braking the rope and for allowing the rope braking device to be easily carried with the user and to be easily operated by the user.

In accordance with one aspect of the invention, there is provided a rope braking device comprising a housing including a chamber formed therein, and including an orifice formed in a bottom portion thereof and communicative with the chamber of the housing, an eyelet engaged in the orifice of the housing and including a bore formed therein for slidably receiving and engaging with a rope and for guiding the rope to move into and out of the chamber of the housing, a pulley including a hub rotatably mounted and supported in the chamber of the housing with a shaft for winding the rope, a follower gear rotatably mounted on the shaft and coupled to the hub and rotated in concert with the hub and the pulley, an internal gear rotatably mounted on the shaft and including a number of teeth provided therein, a number of pinions engaged with the follower gear and the inner teeth of the internal gear, and a spring member for biasing and recovering the internal gear when the pulley is caused or forced to rotate relative to the housing by the rope.

A casing may further be provided and rotatably disposed and supported on the shaft, and the spring member is mounted between the shaft and the casing for biasing and rotating or recovering the casing relative to the shaft. The internal gear is mounted on the casing.

A carrier may further be provided and rotatably supported in the chamber of the housing with the shaft, and the pinions are each rotatably mounted on the carrier with a pivot rod for engaging with the follower gear and for engaging with the inner teeth of the internal gear.

A cap may further be provided and secured to the carrier and engaged with the pinions to stably retain and confine the follower gear and the pinions between the cap and the carrier and for preventing the follower gear and the pinions from being disengaged from the cap and the carrier.

A board may further be provided and mounted on the hub, and a braking member is mounted to the braking member for engaging with the pulley and for braking the pulley and thus for braking the pulling speed of the rope.

A ratchet member may further be provided and mounted to the housing and includes a number of ratchet teeth provided therein, and the board includes a number of pawls pivotally attached the board with pivot pins for engaging with the ratchet teeth of the ratchet member and for limiting the board and the braking member to rotate relative to the housing.

The housing includes two gaskets attached to the housing for engaging with the rope and for guiding the rope to move through the bore of the eyelet. The gaskets each include a curved depression formed therein for stably engaging with the rope and for stably guiding or confining the rope between the gaskets.

The gaskets are rotatably secured to the housing with pivot poles, and include a greater gasket having two side walls for forming a peripheral recess and for engaging with a smaller gasket and for stably retaining and confining the smaller gasket between the side walls of the greater gasket.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
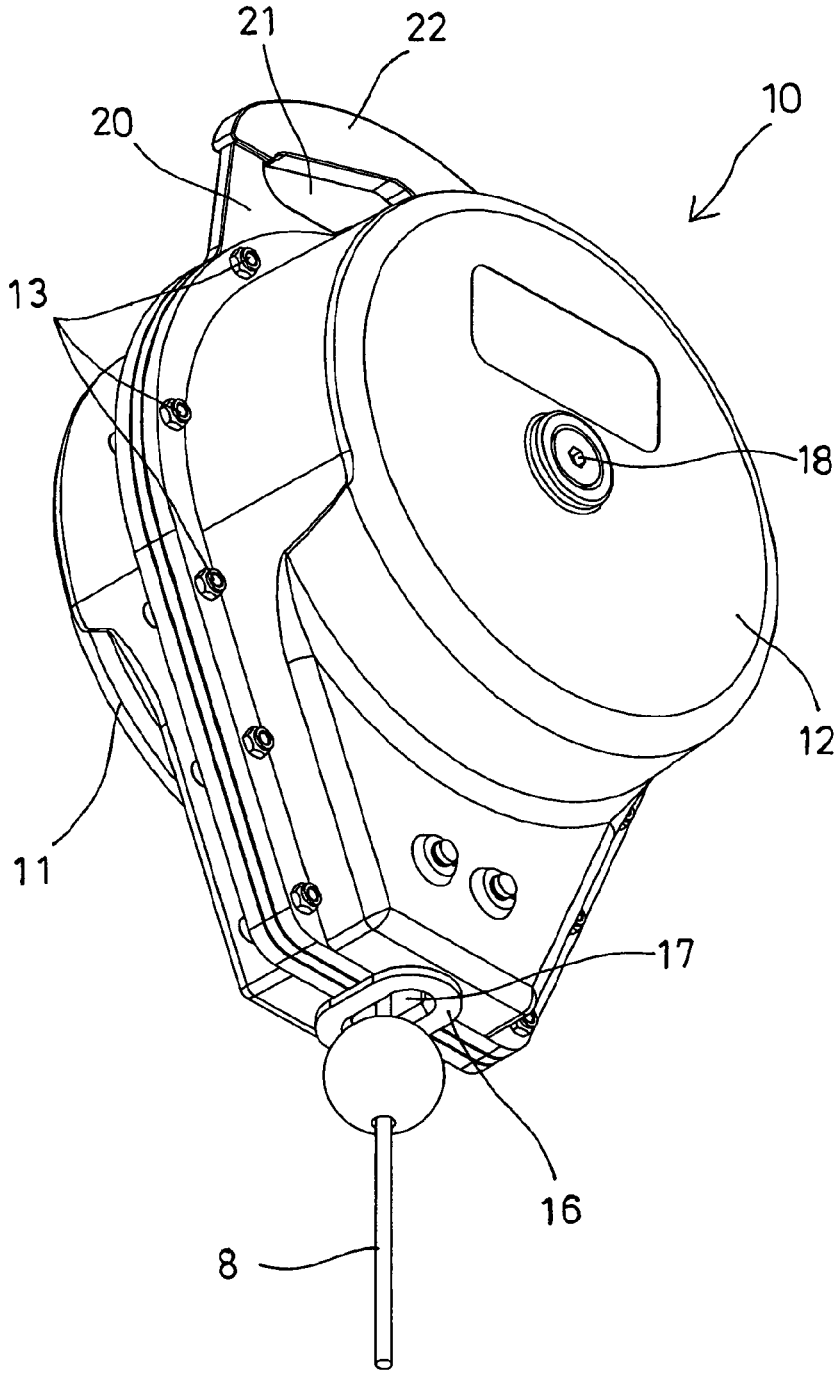
FIG. 1 is a perspective view of a rope braking device in accordance with the present invention.
Figure 2:
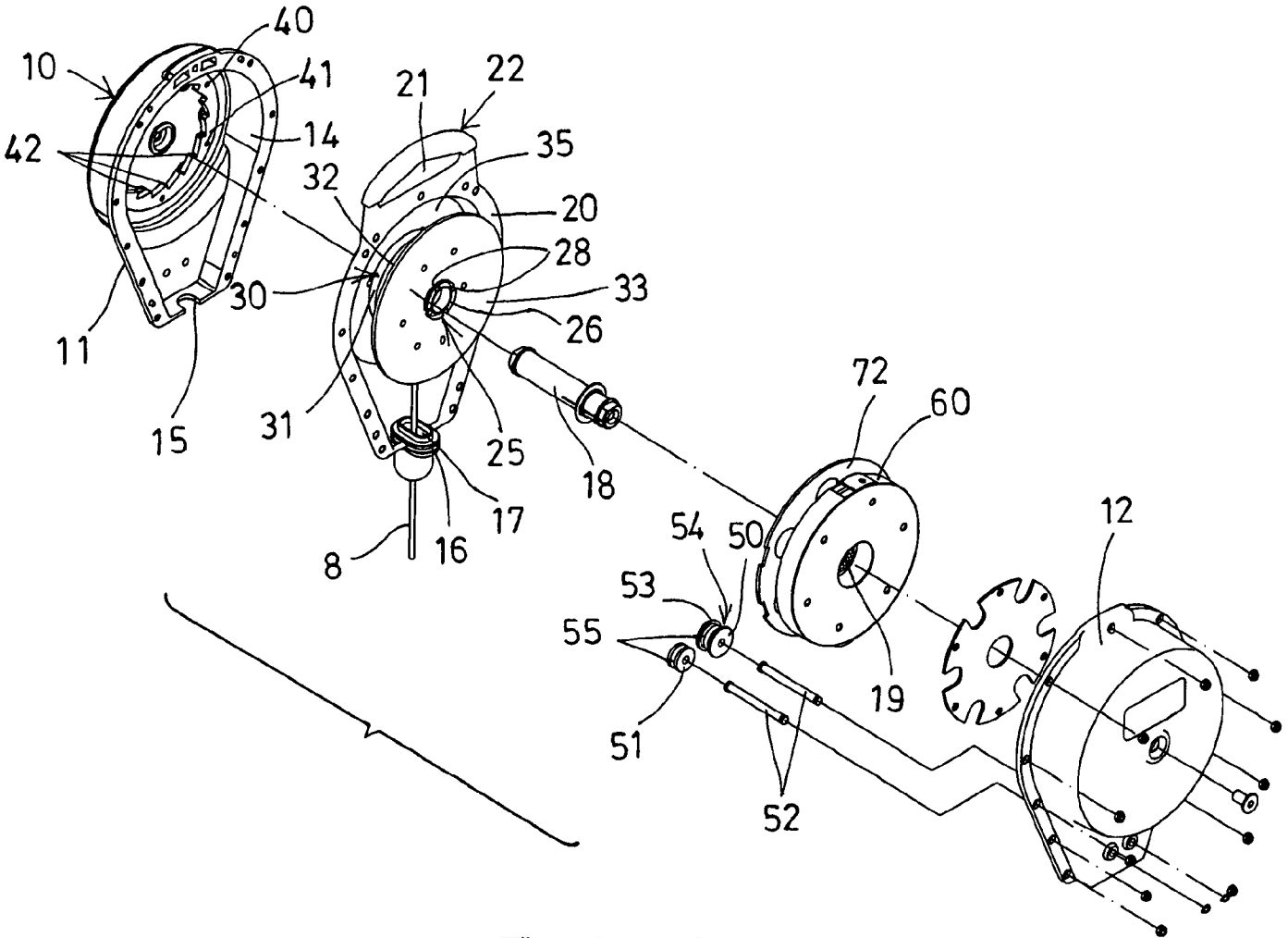
FIG. 2 is a partial exploded view of the rope braking device.
Figure 3:
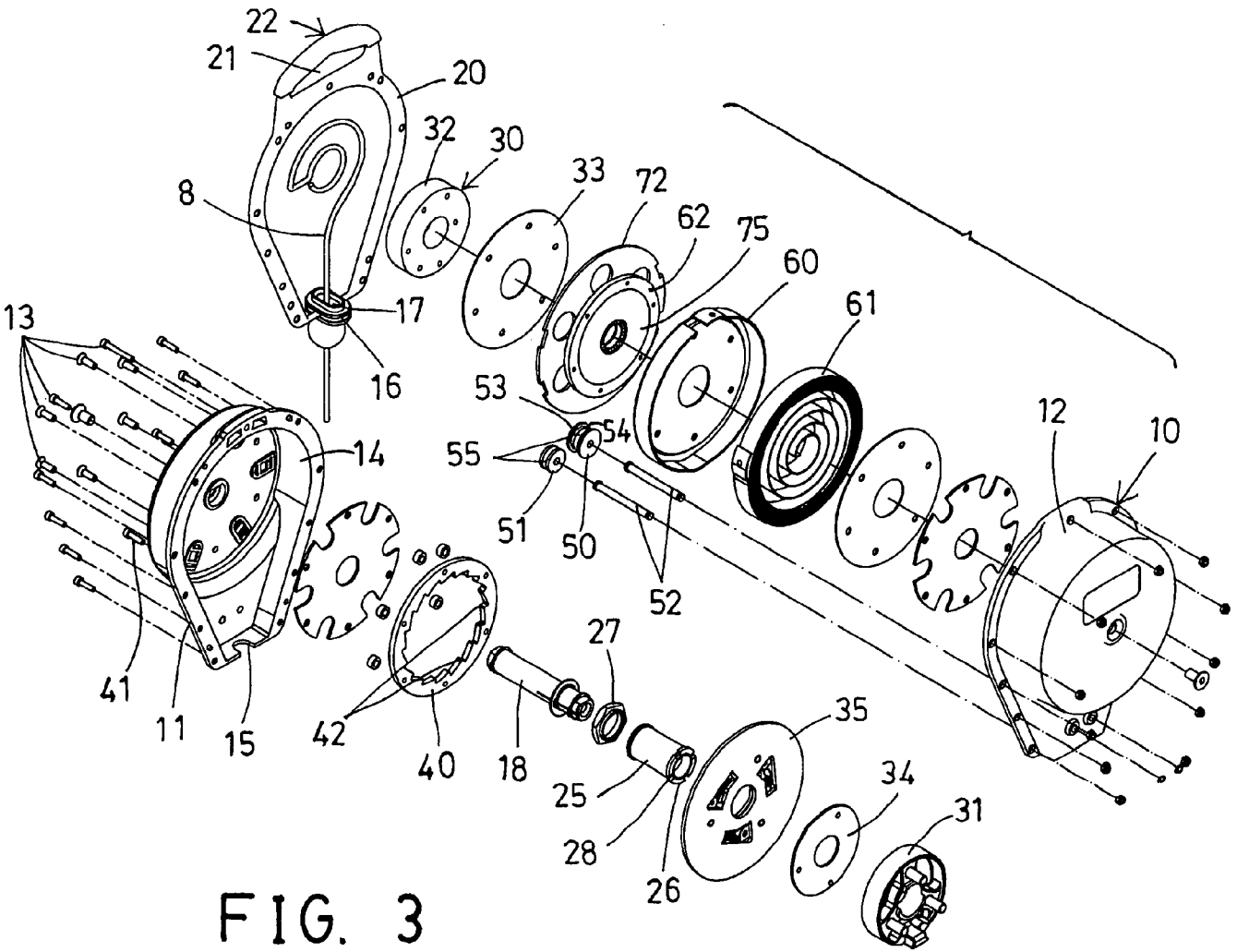
FIG. 3 is another partial exploded view of the rope braking device.
Figure 9:
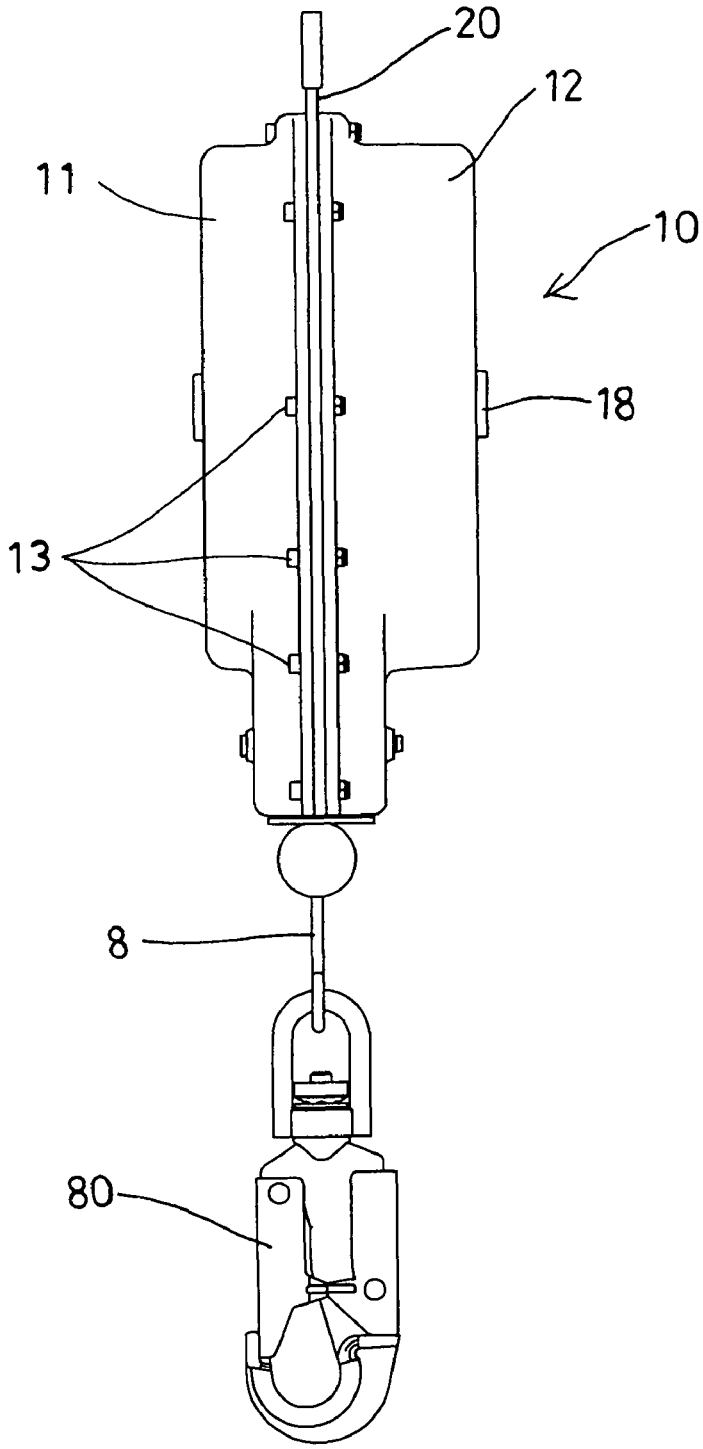
FIG. 9 is a side plan schematic view illustrating the operation of the rope braking device.

Referring to the drawings, and initially to FIGS. 1-3, a rope braking device in accordance with the present invention comprises an outer housing 10 formed by two housing members 11, 12 which may be solidly secured together with latches or fasteners 13, and including a chamber 14 formed therein, and including an orifice 15 formed in the bottom portion thereof and communicative with the chamber 14 of the housing 10 for engaging with a gasket or sealing ring or eyelet 16 which includes a bore 17 formed therein for slidably receiving or engaging with a rope 8 and for smoothly guiding the rope 8 to move into and out of the chamber 14 of the housing 10. A buckle 80 may be attached or mounted or secured to the rope 8 (FIG. 9) for coupling to the user, for example.

A partition or hanger plate 20 is disposed or engaged into the chamber 14 of the housing 10 and disposed or mounted between the housing members 11, 12, and solidly secured between the housing members 11, 12 with the fasteners 13, and the eyelet 16 is also relatively disposed or attached or mounted in the bottom portion of the plate 20. The plate 20 may further include an opening 21 formed therein, such as formed in the upper portion thereof for hanging purposes and for forming or defining a handle 22 on the upper portion thereof, in which the opening 21 and the handle 22 of the plate 20 are disposed or extended out of the housing 10 for allowing the plate 20 and thus the housing 10 to be easily carried with the users.

A wheel or pulley 30 is rotatably attached or mounted or supported in the chamber 14 of the housing 10 with a shaft 18 and formed by two half members 31, 32 (FIGS. 2, 3) for winding and supporting or engaging with the rope 8 and for allowing the rope 8 to be folded and received in the chamber 14 of the housing 10, and comprises a hub 25 disposed or mounted or secured in the center portion of the pulley 30 for rotatably receiving or engaging with the shaft 18 and for allowing the pulley 30 to be smoothly and rotatably supported in the chamber 14 of the housing 10 and to be rotated relative to the housing 10. A panel 33 may be attached or mounted or secured to one side of the pulley 30 for guiding or confining the rope 8 on or around the pulley 30.

A braking shoe or member 34 may further be provided and disposed or mounted on the hub 25 for engaging with the pulley 30 and for braking the pulley 30, and a board 35 is also provided and disposed or mounted on the hub 25 and attached or mounted or secured to the braking member 34 for allowing the board 35 and the braking member 34 to be rotated relative to the pulley 30, the hub 25 includes a peripheral flange 26 extended radially and outwardly from one end thereof for engaging with the panel 33 or the pulley 30, and includes the other end threaded or engaged with a lock nut or fastener 27 which is engaged with the board 35 for stably locking or securing the pulley 30 between the panel 33 and the board 35 and for adjusting the braking force between the pulley 30 and the braking member 34.

Figure 4:
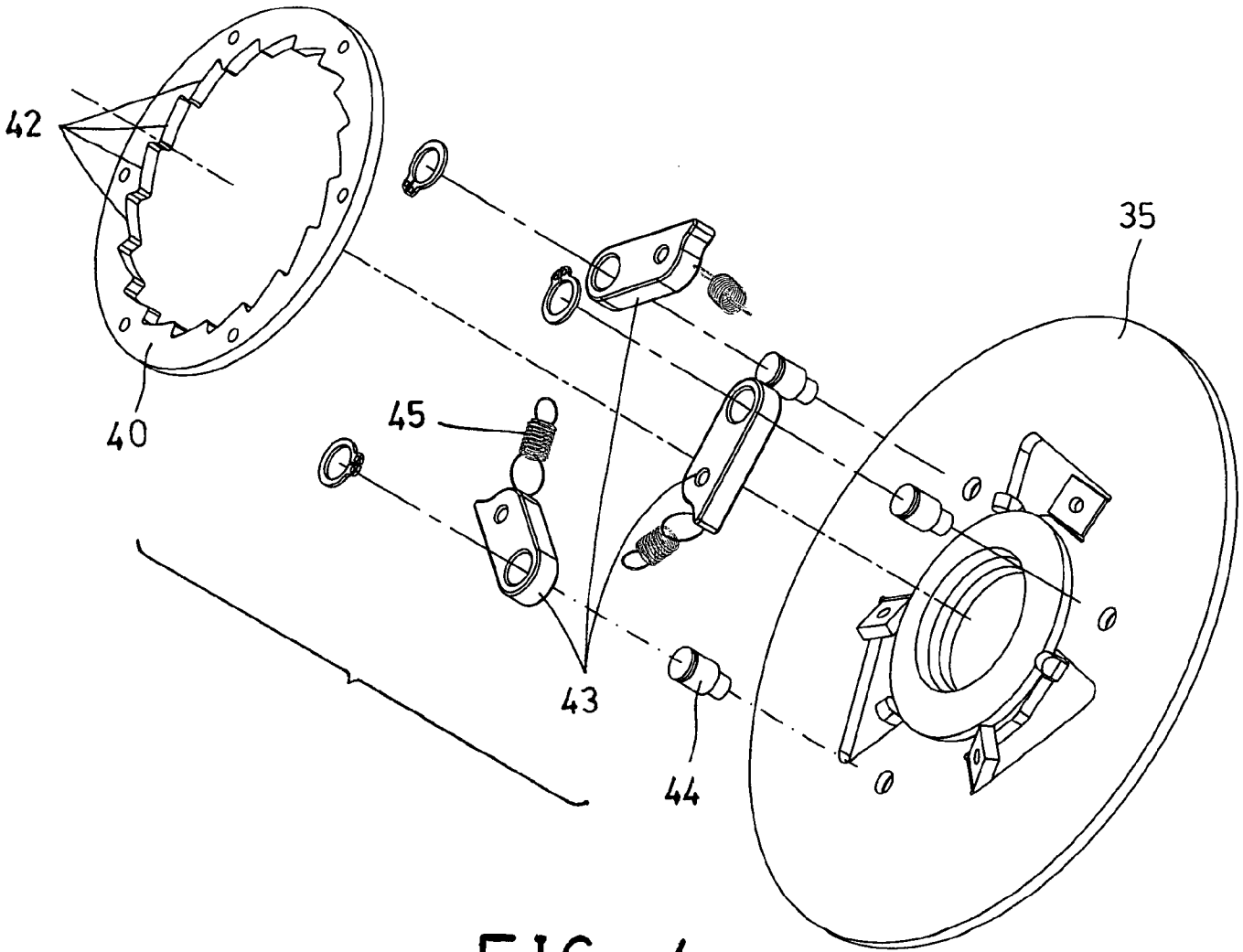
FIG. 4 is a further partial exploded view of the rope braking device.

A ratchet ring or member 40 is attached or mounted or secured to the housing 10, such as secured to the housing member 11 with latches or fasteners 41, and includes a number of inner ratchet teeth 42 provided or formed therein, and one or more (such as three) pawls 43 are pivotally or rotatably coupled or attached or mounted or secured to the board 35 with pivot pins 44 (FIGS. 4, 6) for selectively engaging with the ratchet teeth 42 of the ratchet member 40 and for limiting the board 35 and the braking member 34 to rotate unidirectionally relative to the housing 10, and one or more (such as three) spring members 45 are engaged with the pawls 43 for biasing or forcing the pawls 43 to engage with the ratchet teeth 42 of the ratchet member 40.

In operation, the rope 8 may be attached or mounted or secured or coupled to the user with such as the buckle 80 when the user is conducting a climbing exercise, and when the user is dropped or falling or when the rope 8 is pulled out of the housing 10 by such as the weight of the user, the pulley 30 may be caused or forced to rotate relative to the braking member 34 which may brake or retard the rotational movement of the pulley 30 relative to the housing 10, the fastener 27 is engaged with the board 35 for stably locking or securing the pulley 30 between the panel 33 and the board 35 and for adjusting the braking force between the pulley 30 and the braking member 34.

Two gaskets 50, 51 are attached or mounted or secured to the housing 10, such as secured to the housing member 12 with pivot poles 52, in which a greater gasket 50 includes two side walls 53 for forming or defining a peripheral recess 54 therein and for engaging with the smaller gasket 51 and for stably retaining or confining the smaller gasket 51 between the side walls 53, and the gaskets 50, 51 each include a curved depression 55 formed therein for engaging with the rope 8 and for smoothly guiding the rope 8 to move through the bore 17 of the eyelet 16 and to smoothly move into and out of the chamber 14 of the housing 10 and for preventing the rope 8 from being tilted or inclined relative to the eyelet 16.

A casing 60 is rotatably disposed or engaged or attached or mounted or supported on the shaft 18, and a coil spring member 61 is disposed or engaged or attached or mounted between the shaft 18 and the casing 60 for biasing or rotating or recovering the casing 60 relative to the shaft 18. An internal gear 62 (FIGS. 5, 8) is attached or mounted or secured to the casing 60 with latches or fasteners 63 such that the internal gear 62 and the casing 60 are rotated in concert with each other relative to the shaft 18, and the internal gear 62 includes a number of inner teeth 64 provided or formed in the inner peripheral portion thereof, the spring member 61 may bias or rotate or recover both the internal gear 62 and the casing 60 relative to the shaft 18.

Figure 5:
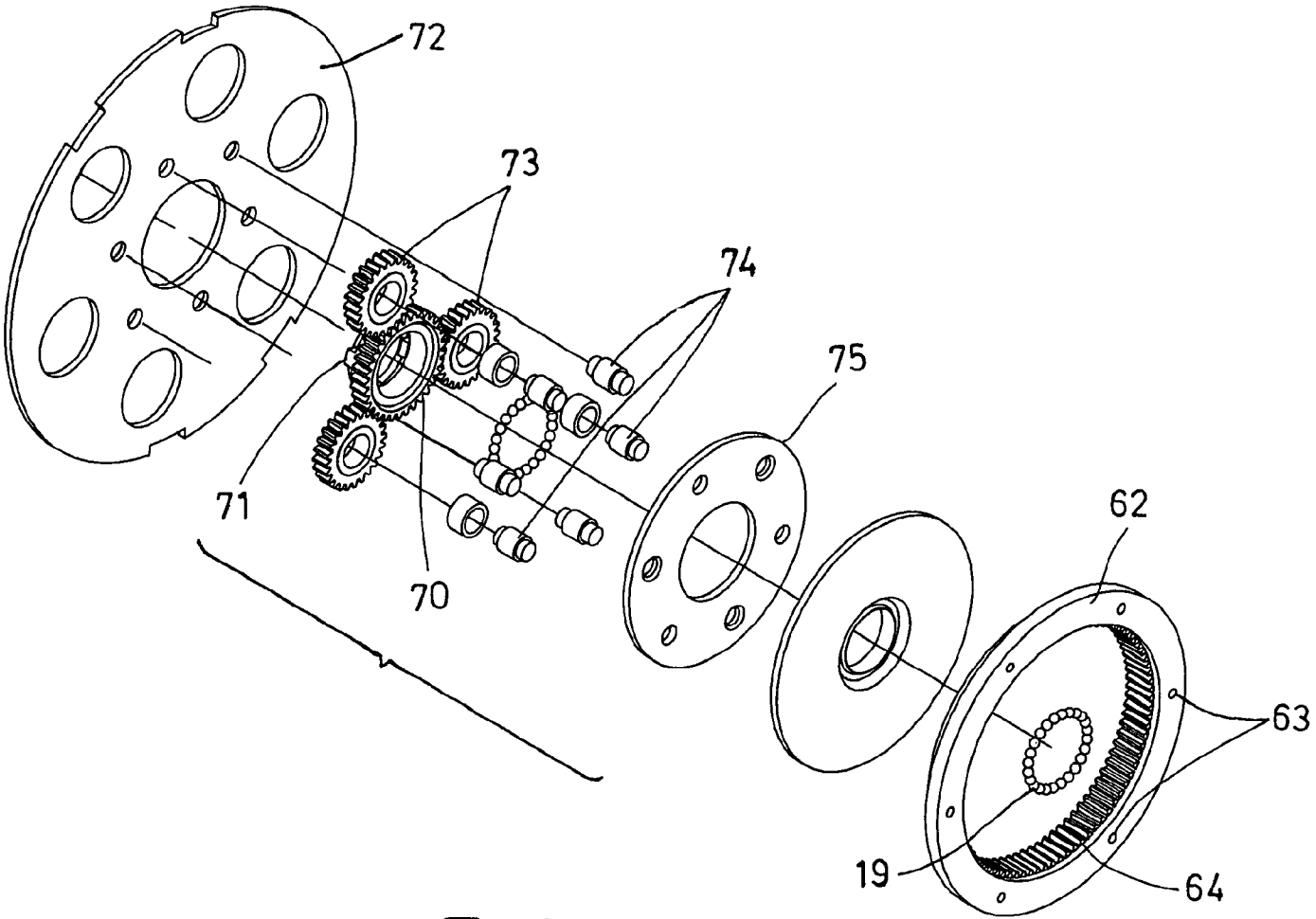
FIG. 5 is a still further partial exploded view of the rope braking device.
Figure 8:
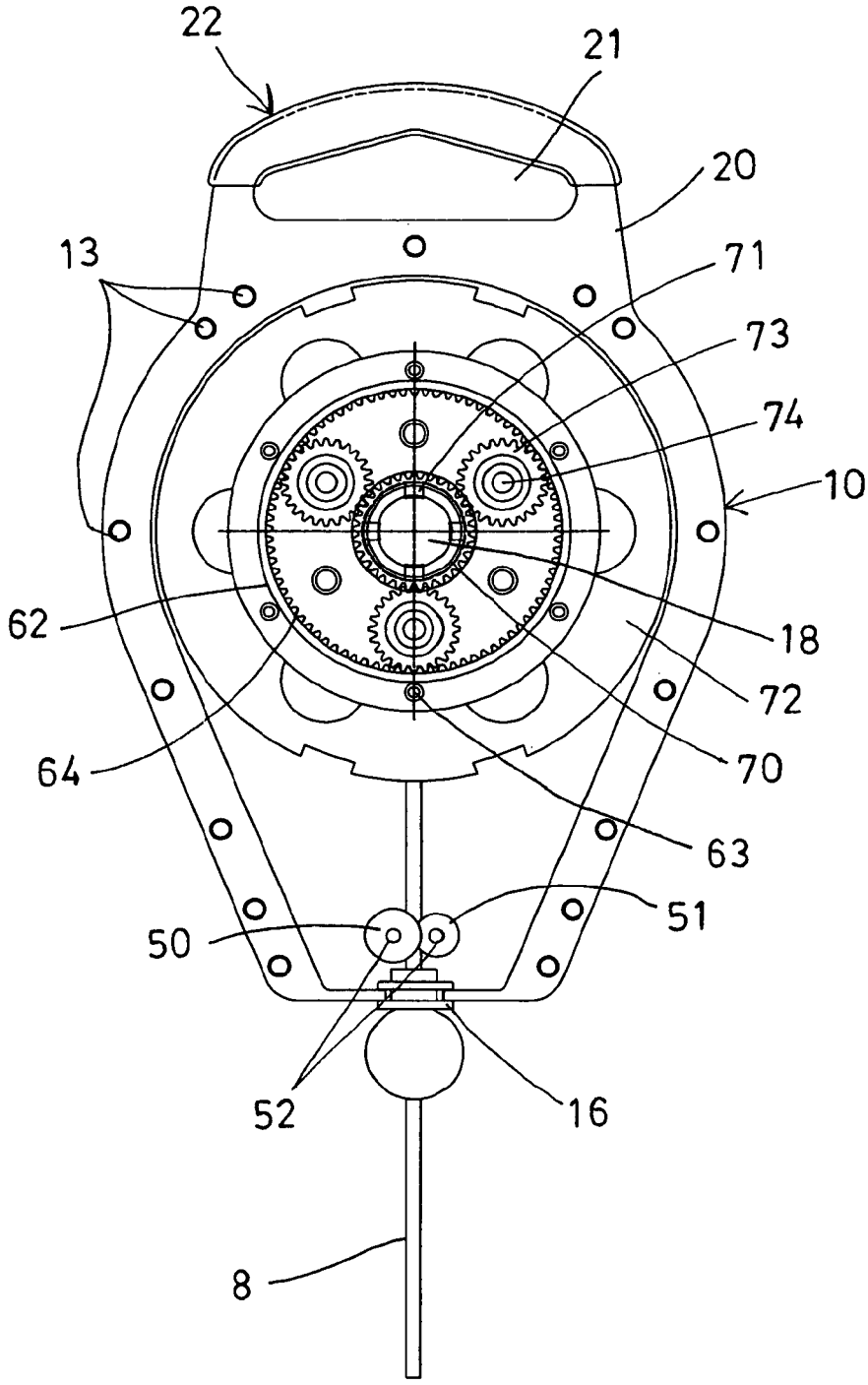
FIG. 8 is another plan schematic view of the rope braking device, in which a portion of the rope braking device is removed for showing the inner structure of the rope braking device.

As shown in FIGS. 5 and 8, a follower gear 70 is rotatably attached or mounted or secured to the shaft 18 with a bearing device 19 (FIG. 5) and includes one or more keys 71 extended radially and outwardly therefrom for engaging with the corresponding notches 28 of the hub 25 (FIGS. 2, 3) and for anchoring or securing the follower gear 70 to the hub 25 and for allowing the follower gear 70 and the hub 25 to be rotated in concert with each other. A carrier 72 is rotatably attached or mounted or supported in the chamber 14 of the housing 10 with the shaft 18 and/or the hub 25, and one or more (such as three) pinions 73 are rotatably attached or mounted or supported on the carrier 72 with pivot rods 74 and meshed or engaged with the follower gear 70, and also meshed or engaged with the inner teeth 64 of the internal gear 62.

In operation, the follower gear 70 and the hub 25 and the pulley 30 may be pulled and rotated relative to the housing 10 by the rope 8 and the weight of the user, the follower gear 70 may also be caused or forced to rotate relative to the shaft 18 by the hub 25. At this moment, the pinions 73 and the carrier 72 may be caused or forced to rotate relative to the follower gear 70, and the internal gear 62 and the casing 60 may also be caused or forced to rotate relative to the shaft 18, the spring member 61 may bias or rotate or recover both the internal gear 62 and the casing 60 relative to the shaft 18 to apply a resistive force against the rotational movement of the pulley 30 relative to the housing 10 and the outward pulling of the rope 8. A cap 75 may be secured to the carrier 72 for stably retaining or confining the follower gear 70 and the pinions 73 between the cap 75 and the carrier 72.

Figure 6:
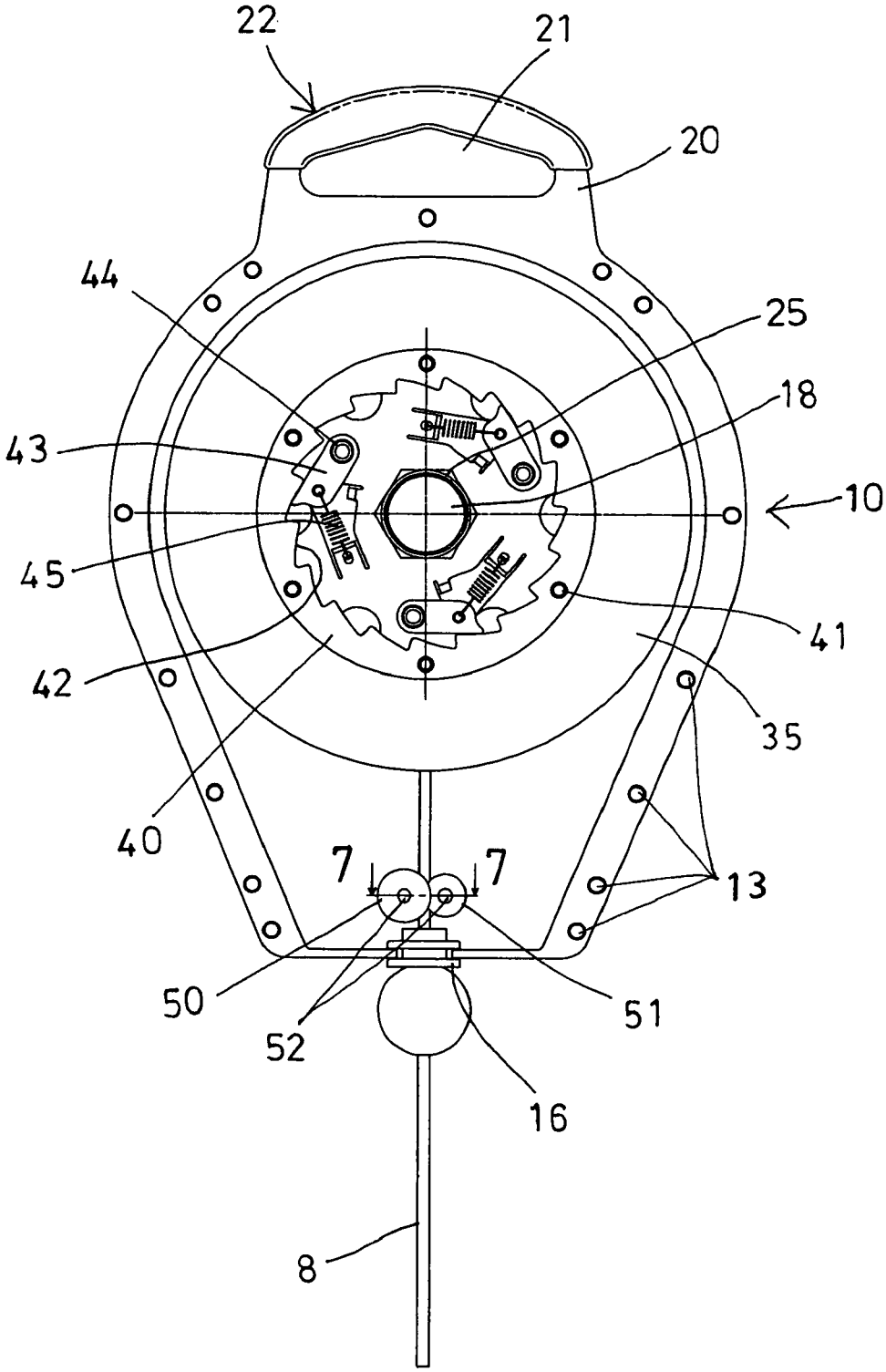
FIG. 6 is a plan schematic view of the rope braking device, in which a portion of the rope braking device is removed for showing the inner structure of the rope braking device.
Figure 7:
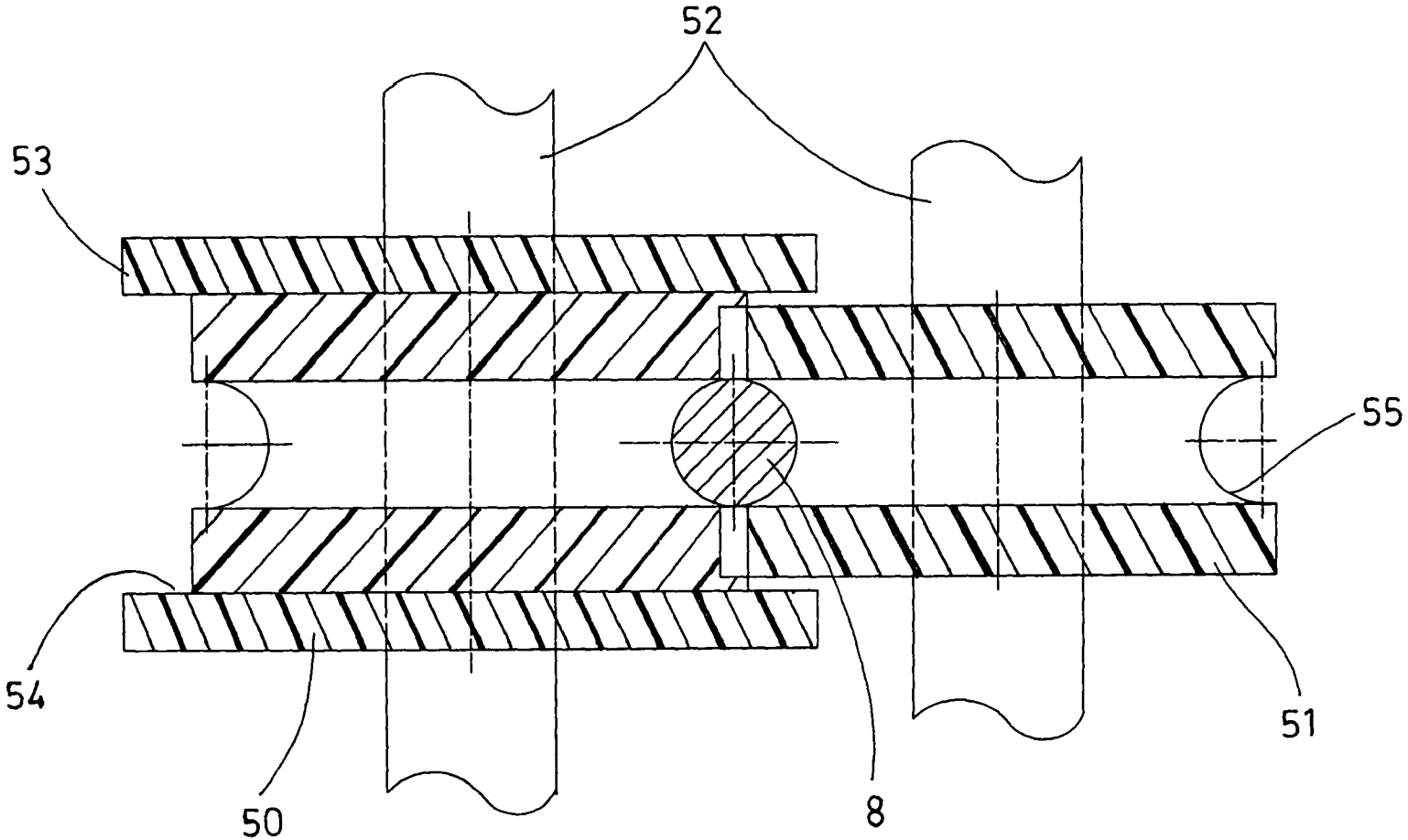
FIG. 7 is a cross sectional view of the rope braking device taken along lines 7-7 of FIG. 6.

It is to be noted that the rope 8 may be stably retained or confined between the gaskets 50, 51 and may be stably engaged with the curved depression 55 of the gaskets 50, 51, best shown in FIGS. 6-8 and may then be stably guided to move through the bore 17 of the eyelet 16 and to smoothly move into and out of the chamber 14 of the housing 10 and may be prevented from being tilted or inclined relative to the eyelet 16. The coupling of the carrier 72 and the pinions 73 between the follower gear 70 and the internal gear 62 and the casing 60 allows the pulley 30 to be smoothly and rotated relative to the housing 10, and allows the spring member 61 to suitably bias or rotate or recover both the internal gear 62 and the casing 60 relative to the shaft 18 and to apply a resistive force against the rotational movement of the pulley 30 relative to the housing 10 and the outward pulling of the rope 8. The rope braking device includes a compact structure that may be easily carried with the user and that may be easily operated by the user.

Accordingly, the rope braking device in accordance with the present invention includes an improved and simplified structure for effectively braking the rope and for allowing the rope braking device to be easily carried with the user and to be easily operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rope braking device comprising:

a housing including a chamber formed therein, and including an orifice formed in a bottom portion thereof and communicative with said chamber of said housing, an eyelet engaged in said orifice of said housing and including a bore formed therein for slidably receiving and engaging with a rope and for guiding said rope to move into and out of said chamber of said housing, a pulley including a hub rotatably mounted and supported in said chamber of said housing with a shaft for winding said rope, a follower gear rotatably mounted on said shaft and coupled to said hub and rotated in concert with said hub and said pulley, an internal gear rotatably mounted on said shaft and including a plurality of teeth provided therein, a plurality of pinions engaged with said follower gear and said inner teeth of said internal gear, and a spring member for biasing said internal gear.

2. The rope braking device as claimed in claim 1, wherein a casing is rotatably disposed and supported on said shaft, and said spring member is mounted between said shaft and said casing for biasing said casing relative to said shaft.

3. The rope braking device as claimed in claim 2, wherein said internal gear is mounted on said casing.

4. The rope braking device as claimed in claim 1, wherein a carrier is rotatably supported in the chamber of the housing with the shaft, and said pinions are each rotatably mounted on said carrier with a pivot rod.

5. The rope braking device as claimed in claim 4, wherein a cap is secured to said carrier to retain said follower gear and said pinions between said cap and said carrier.

6. The rope braking device as claimed in claim 1, wherein a board is mounted on said hub, and a braking member is mounted to said hub for engaging with and braking said pulley.

7. The rope braking device as claimed in claim 6, wherein a ratchet member is mounted to said housing and includes a plurality of ratchet teeth provided therein, and said board includes a plurality of pawls pivotally attached said board with pivot pins for engaging with said ratchet teeth of said ratchet member and for limiting said board and said braking member to rotate relative to said housing.

8. The rope braking device as claimed in claim 1, wherein said housing includes two gaskets attached to said housing for engaging with said rope and for guiding said rope to move through said bore of said eyelet.

9. The rope braking device as claimed in claim 8, wherein said gaskets are rotatably secured to said housing with pivot poles, and include a greater gasket having two side walls for forming a peripheral recess and for engaging with a smaller gasket and for confining said smaller gasket between said side walls.

10. The rope braking device as claimed in claim 9, wherein said gaskets each include a curved depression formed therein for engaging with said rope.

* * * * *